US008689720B2

(12) United States Patent
Eide

(10) Patent No.: US 8,689,720 B2
(45) Date of Patent: Apr. 8, 2014

(54) OFFSHORE EQUIPMENT DEPLOYING AND RETRIEVING VESSEL

(75) Inventor: Georg Eide, Høylandsbygd (NO)

(73) Assignee: Eide Marine Services AS, Hoylandsbygd (NO)

( * ) Notice: Subject to any disclaimer, the term of this patent is extended or adjusted under 35 U.S.C. 154(b) by 72 days.

(21) Appl. No.: 13/395,732

(22) PCT Filed: Jul. 9, 2010

(86) PCT No.: PCT/EP2010/059865

§ 371 (c)(1), (2), (4) Date: Mar. 13, 2012

(87) PCT Pub. No.: WO2011/029642

PCT Pub. Date: Mar. 17, 2011

(65) Prior Publication Data

US 2012/0192782 A1 Aug. 2, 2012

(30) Foreign Application Priority Data

| | | |
|---|---|---|
| Sep. 14, 2009 | (NO) | 20093001 |
| Sep. 15, 2009 | (NO) | 20093006 |
| Nov. 26, 2009 | (NO) | 20093426 |

(51) Int. Cl.
*B63B 35/44* (2006.01)

(52) U.S. Cl.
USPC ..... 114/258; 212/270

(58) Field of Classification Search
USPC ..... 114/258, 259, 260, 264, 265, 268; 212/234, 270
See application file for complete search history.

(56) References Cited

U.S. PATENT DOCUMENTS

| | | | | |
|---|---|---|---|---|
| 1,533,776 | A * | 4/1925 | Tiburtius | 114/260 |
| 4,492,310 | A * | 1/1985 | Weingart | 114/260 |
| 4,898,289 | A * | 2/1990 | van de Wetering | 114/264 |
| 5,215,024 | A | 6/1993 | McAllister | |
| 2006/0086304 | A1 | 4/2006 | Menard | |

FOREIGN PATENT DOCUMENTS

| | | | |
|---|---|---|---|
| GB | 2156286 | A | 10/1985 |
| GB | 2168293 | A | 6/1986 |
| GB | 2191154 | A | 12/1987 |
| WO | WO-85/03050 | A1 | 7/1985 |
| WO | WO-93/04914 | A1 | 3/1993 |
| WO | WO-99/12807 | A1 | 3/1999 |
| WO | WO-99/57011 | A1 | 11/1999 |
| WO | WO-2007/097611 | A1 | 8/2007 |
| WO | WO-2009/084950 | A1 | 7/2009 |

(Continued)

OTHER PUBLICATIONS

Brumer, Alexandre, "International Search Report" for PCT/EP2010/059865, as mailed Oct. 26, 2010, 4 pages.

*Primary Examiner* — Lars A Olson
(74) *Attorney, Agent, or Firm* — Winstead PC

(57) ABSTRACT

A mono hull vessel for retrieving and deploying equipments in offshore region comprising a deck box with an upper deck (2) at its top said upper deck having a lifting and lowering device (3,3'), a hull/pontoon (1) at the base of said vessel, the vessel is characterized in that said hull/pontoon (1) is connected to the deck box by a plurality of columns (4) and said hull/pontoon (1) is made in one piece and is continuous to form the platform for a lower deck (5), the upper and lower deck being configured to allow lifting and lowering of equipment therefrom and thereon respectively.

6 Claims, 7 Drawing Sheets

(56) References Cited

FOREIGN PATENT DOCUMENTS

| | | | |
|---|---|---|---|
| WO | WO-2009/102196 | A2 | 8/2009 |
| WO | WO-2009/102197 | A2 | 8/2009 |
| WO | WO-2010/020026 | A2 | 2/2010 |

* cited by examiner

OFFSHORE EQUIPMENT DEPLOYING AND RETRIEVING VESSEL

FIELD OF THE INVENTION

The present invention in general relates to a vessel for retrieving and deploying equipment(s) in offshore region. The vessel is semi-submersible and can also work as a normal sailing vessel in non-submerged condition. The present invention also relates to a method of retrieving and deploying equipment(s) in off shore region, applying such semi-submersible vessel. In particular, the present invention provides an offshore vessel and also a method of deploying and retrieving equipment(s) in off shore region without subjecting the equipments and lifting/lowering devices to dynamical forces in the splash zone/water surface.

TECHNICAL BACKGROUND OF THE INVENTION

In offshore regions applying vessels for deploying and retrieving heavy equipments is well known. Such heavy equipments are known to relate to oil and gas exploration and production, mining and mineral exploration, drilling operations and so on.

For example, WO 2010/020026A2 discloses a double hall catamaran type vessel having a deck and a common bridge for loading and unloading operations of supplies, in the oil sector. However, this vessel is not suitable for offshore areas where waves go up to even ten meters high, such as in the North Sea. In these areas, where the sea is known to be hostile, mono hull off shore vessels have been tried such as the ones disclosed in WO 2009/102197 and WO 2009/102196. However, over the years it has been observed that these mono hull off shore vessels, such as disclosed in these two publications, are not suitable for many off shore operations, particularly in hostile seas, such as in North Sea, Brazil and Gulf of Mexico having regard to stability and safety considerations.

Semi-submersible vessels for use in various types of offshore work are known in the art. These vessels are particularly useful in offshore regions where the sea is hostile. It is also known, that these semi-submersible vessels are designed to take care of safety and stability considerations, which are of prime importance in such hostile offshore areas. For example, WO 99/12807 discloses a semi-submersible vessel design which provides a strong and substantially rigid base to support the deck(s) of the superstructure. WO 2009/084950, discloses semi-submersible vessels which are braceless. WO85/03050 discloses a geometrically improved semi-submersible vessel having a buoyant centre column centrally disposed about the drilling central string. This design was meant to significantly reduce heave motion under sea states. WO 99/57011 discloses a design of a semi-submersible vessel which ensures safety of the mineral exploration platform it supports. WO 2007/097611 discloses a semi-submersible vessel which has an assembly of hull section, support structure and deck structure, the deck structure having reinforcement for surviving storms.

However, certain vital disadvantages have been observed in respect of the vessels in the preceding paragraph and similar such vessels. Primarily, designing such vessels involve very high costs and long project implementation time for observing proper safety considerations in hostile weather and sea conditions. Further, those involve deployment of large cranes and lifting gears which add on to the costs and operational inconveniences. Additionally, existing vessels have variable drafts in harbours and are basically barges with too much motion and become unreliable in extremely hostile weather, despite all manoeuvrings. In addition, these vessels are not ship shaped and so cannot perform effectively as normal sailing vessels in non-submerged conditions, because it has almost been an accepted fact that ship-shaped vessels are less suitable for many offshore operations. Furthermore, deployment and retrieving of heavy equipments applying these vessels result in that the equipments and lifting/lowering devices are subjected to the dynamical forces in the splash zone.

Such vessels as referred to in the preceding paragraph, are also not known to have an optional temporary port which function on an identical principle as the main vessel, for accommodating crew vessels/supply vessels/any other vessels for safe transfer of crew and material. U.S. Pat. No. 5,215,024 does disclose an open ocean based berthing facility for capturing a ship or similar vessel, but it is mainly directed to serve the purpose of sea bases for defence purpose. The berthing facility has a buoyant platform having an enclosure formed therein for receiving the vessel. Movement of the vessel is coupled to the movement of the platform so that relative motion between the vessel and platform is relatively reduced. This technology does not disclose a semi-submersible vessel for offshore activities, which nullifies/substantially reduces the disadvantages of prior art as disclosed in the previous paragraph and simultaneously, has an optional temporary port which function on an identical principle as the main vessel, for accommodating crew vessels/supply vessels/any other vessels for safe transfer of crew and material. The same observations hold good in respect of the technology disclosed in US2006/0086304 and in WO93/04914. The former discloses a vessel for rescuing vessels in distress. The rescue vessel has an elongated basin and a ballast device. There are two lateral hulls surrounding the basin and delimiting an upper edge of the rescue vessel. When the vessel to be rescued is evacuated, the upper edge of the rescue vessel is above sea level. When a vessel is to be rescued, the upper edge of the rescue vessel is below the keel of the vessel in distress. Although it is stated in the document US2006/0086304, that such rescue vessels may be applied in respect of drilling or production platforms and parts of such platforms, but no clear teaching exists regarding a semi-submersible for offshore activities, which nullifies/substantially reduces the disadvantages of prior art as disclosed in the previous paragraph and simultaneously, has an optional temporary port which function on an identical principle as the main vessel, for accommodating crew vessel(s)/supply vessel(s)/any other vessel(s) for safe transfer of crew and material. Identical observations hold good in respect of WO93/04914 which discloses a jumbo barge carrier fast sealift and port system having a trapezoidal double hull design. It includes a barge-carrying vessel, at least one cargo carrying barge, a transportable port system and a causeway. It relates to rapid transport and deployment of extremely large amounts of cargo needed to meet humanitarian, economic and military contingencies and strictly speaking does not relate to a semi-submersible vessel for retrieving and deploying equipment(s) in offshore region, which is the subject matter of the present invention.

Hence, there was a long felt need to design a semi-submersible vessel which nullifies/substantially reduces the aforesaid drawbacks in general and which in particular is a mono hull column stabilised unit which is cost effective, stable and reliable in extremely hostile sea conditions, is adapted to sail as a vessel with low draft at a fairly high speed in non-submerged condition. There was also a long felt need to develop a semi-submersible vessel, which is ship shaped and is simultaneously adapted to be applied effectively in a wide range of offshore applications. Furthermore, there was long felt need to design a semi-submersible vessel which nullifies/substantially reduces the drawbacks in such known semi-submersible vessels and simultaneously has an optional temporary port which functions on an identical principle as the main vessel, for accommodating crew vessels/supply vessels/any other vessels for safe transfer of crew and material. There was also a long felt need for designing a method for deploying and retrieving heavy equipments from water, in offshore operations without subjecting the equipments and the lifting/lowering devices to the dynamical forces of the splash zone/water line, by submerging and retrieving the section through water, instead of the usual method of lowering it through the water line.

The present invention, meets the above long felt needs and other needs associated therewith and the construction of the mono hull column stabilized semi-submersible vessel as disclosed hereinafter, is consequential to the present invention.

OBJECTS OF THE INVENTION

The present invention aims to meet the above needs hitherto not taught by prior art, by providing a specially constructed mono hull vessel for deploying and retrieving equipments in offshore region, which vessel by virtue of its specially configured construction ensures that the disadvantages of prior art, as discussed hereinbefore, are substantially reduced/nullified.

Another object of the present invention is to provide a mono hull vessel for deploying and retrieving equipments in the offshore region which is stable and reliable in extremely hostile sea conditions.

Another object of the present invention is to provide a mono hull vessel for deploying and retrieving equipments in the offshore region which has a cost effective design and can ensure deployment and retrieval of equipments without any splashing effect.

Another object of the present invention is to provide a mono hull vessel for deploying and retrieving equipments in the offshore region which is adapted to sail as a vessel with low draft at a fairly high speed in non-submerged condition.

A further object of the present invention is to provide a mono hull vessel for deploying and retrieving equipments in the offshore region, which is a mono hull column, stabilized unit, is ship shaped and is simultaneously adapted to be applied effectively in a wide range of offshore applications.

Another object of the present invention is to provide a mono hull vessel for deploying and retrieving equipments in offshore regions which has an optional temporary port and functions on an identical principle as the main vessel, for accommodating crew vessels/supply vessels/any other vessels for safe transfer of crew and material.

Another object of the present invention is to provide a method for deploying and retrieving heavy equipments from water, in offshore operations without subjecting the equipment and the lifting/lowering devices to the dynamical forces of the splash zone by submerging and retrieving the section through water, instead of the usual method of lowering/retrieving it through the water line.

A further object of the present invention is to provide a novel hull/pontoon for its application on a mono hull vessel for deploying and retrieving equipments in the offshore region which is stable and reliable in extremely hostile sea conditions.

In addition, the present invention discloses some advantageous features still not disclosed in prior art.

All through the specification including the claims, the words "vessel/unit", "deck box", "mono hull", "upper deck", "lower deck", "hull/pontoon", "columns", "temporary port" are to be interpreted in the broadest sense of the respective terms and includes all similar items in the field known by other terms, as may be clear to persons skilled in the art. Restriction/limitation, if any, referred to in the specification, is solely by way of example and understanding the present invention. Further, it should be understood to persons skilled in the art that the expressions "ship", "ship shaped", "ship like shape" according to the present invention should be interpreted as relating to all normal sailing vessels as known to persons skilled in the art. The present invention has been explained in this Complete Specification at places, with reference to "ship", "ship shaped", and "ship like shape" only for the sake of understanding and not by way of any limitation.

SUMMARY OF THE INVENTION

According to a first aspect of the present invention there is provided a mono hull vessel for retrieving and deploying equipments in offshore region comprising a deck box with an upper deck at its top said upper deck having a lifting and lowering facility, a hull/pontoon at the base of said vessel. According to the invention, hull/pontoon is connected to the deck box by a plurality of columns. The hull/pontoon is made in one piece and is continuous to form the platform for a lower deck. The upper and lower deck are configured to allow lifting and lowering of equipment therefrom and thereon respectively.

According to an advantageous embodiment of a first aspect of the present invention, the vessel is adapted to submerge and to move up the lower deck to and from a desired depth, below the water level.

Preferably, the columns are 4 to 10 in number and the assembly of the upper deck, the deck box, the lower deck are designed in coherence with the hull/pontoon which is similar to that of a ship and is submersible, to impart a ship like shape to said vessel in totality, whereby said vessel is adapted to function as a normal sailing vessel in non-submerged condition.

According to another advantageous embodiment of a first aspect of the present invention, the deck box has engine room, large space for said equipments, accommodation units and there is a helipad on said upper deck.

According to a further advantageous embodiment of a first aspect of the present invention, the hull/pontoon has ballast tanks, fuel tanks, FW tanks and thruster engine room and said lower deck also has a forecastle deck.

More preferably, the ballast tanks are provided in the lower hull and parts of said columns.

According to another advantageous embodiment of the first aspect of the present invention, the displacement in submerged condition of the vessel is approximately 45000 tons and loading capacity of said upper deck is 6000 to 8000 tons and the moon pool is arranged all the way from said upper deck to bottom hull.

According to another advantageous embodiment of the first aspect of the present invention, the vessel is provided at its aft region, with a temporary port unit for crew vessels or supply vessels or other vessels.

Preferably, the port unit comprises a sluice gate arrangement at end of said aft region and is provided with a sheltered area.

More preferably, the temporary port is adapted to be moored on a turret system.

The vessel according to the present invention is adapted to be applied as any one of or a combination of two or more of deep sea construction vessel, intervention vessel, construction vessel, drilling unit, Anchor Handling Tug Supply (AHTS), heavy lift vessel, windmill installation vessel, pipe layer, deep water mining vessel, accommodation unit, tender unit.

According to a second aspect of the present invention there is provided a method for submerging equipment(s) through water without subjecting the equipment and lifting/lowering devices to the dynamical forces of the splash zone in off shore region, said method comprising providing a mono hull column stabilized semi submersible vessel having a deck box with an upper deck at its top having a lifting and lowering device, a hull/pontoon at the base of said vessel which is similar to that of a ship hull and is submersible, said hull/pontoon being connected to the deck box by a plurality of columns, said hull/pontoon is made in one piece and is continuous to form the platform for a lower deck, the upper deck is configured to allow lowering of equipment therefrom on the lower deck, said vessel is adapted to submerge said lower deck to a desired depth below the water level in the event of placement of said equipment on the lower deck and to lift and lower said equipment from the lower deck so submerged, by virtue of said lifting and lowering device on the upper deck. According to the invention, the method involves:

a) placing said equipment(s) on said lower deck from said upper deck by said lifting and lowering facility, b) submerging the lower deck to the desired depth below the water level, c) applying the lifting device and lifting said equipment(s) partially above said lower deck, d) turning said equipment(s) and lowering it in water by means of the lowering device.

According to a third aspect of the present invention there is provided a method for retrieving a submerged equipment(s) through water without subjecting the equipment and lifting/lowering device to the dynamic forces in the splash zone in off shore region, said method comprising providing a mono hull column stabilized semi submersible vessel having a deck box with an upper deck at its top, said upper deck having a lifting and lowering device, a hull/pontoon at the base of said vessel which is similar to that of a ship and is submersible, said hull/pontoon being connected to the deck box by a plurality of columns, said hull/pontoon is made in one piece and is continuous to form the platform for a lower deck, the upper deck and lower deck are configured to allow lifting of equipment thereon. According to the invention, the method involves:

a) submerging said vessel such that the lower deck is at a desired depth below the water level, c) lifting and placing said equipment(s) on said lower deck from water by said lifting and lowering device, d) moving the vessel up the water such that the lower deck is above the water level.

According to a fourth aspect of the present invention, there is provided a hull/pontoon for its application on a mono hull vessel according to the first aspect of the present invention, for retrieving and deploying equipments in offshore region. According to the fourth aspect of the present invention, the hull/pontoon is made in one piece and is continuous to form the platform for a lower deck and said hull/pontoon is designed to have a shape as that of a ship hull.

SHORT DESCRIPTION OF THE FIGURES

Having described the main features of the invention above, a more detailed and non-limiting description of some exemplary embodiments will be given in the following with reference to the drawings, in which FIG. 1 is a perspective view of the mono hull vessel according to a preferred embodiment of the present invention.

DETAILED DESCRIPTION OF THE INVENTION

The following provides detailed description of some non-limiting exemplary embodiments of the present invention.

Figure 1:
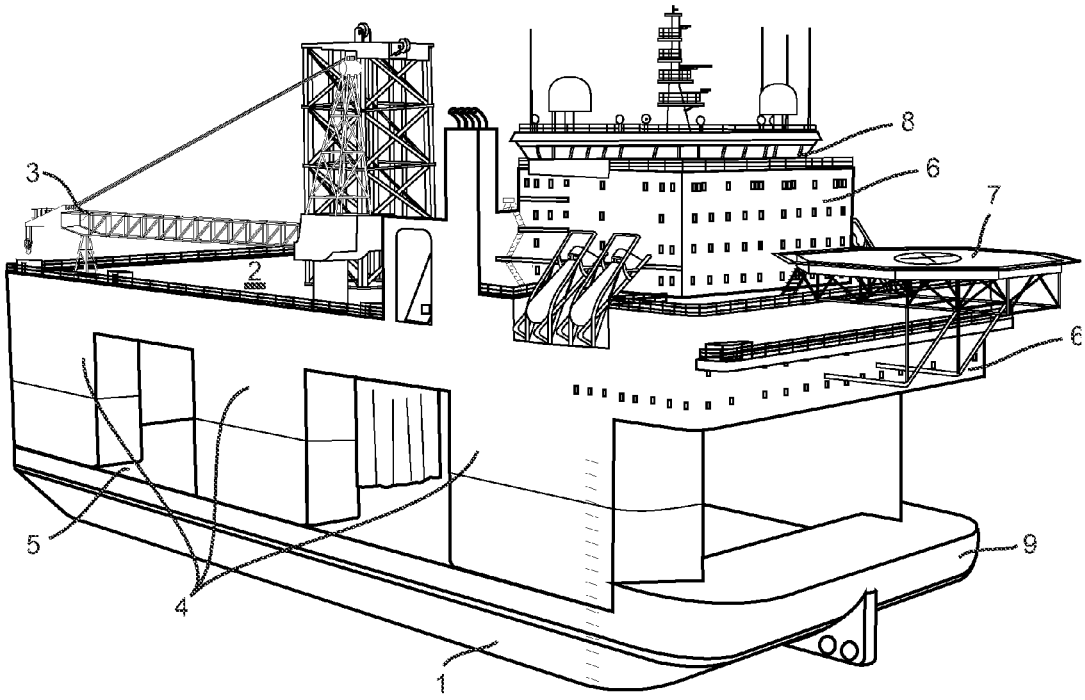

As illustrated in the accompanying FIG. 1 the mono hull vessel according to the present invention has an upper deck 2 with a very large area for accommodating heavy equipments. The upper deck 2 is at the top of the deck box and deck box is equipped with accommodation units 6, a helipad 7 and canning bridge or navigation bridge 8. The hull/pontoon 1 is made in one piece and is continuous to form the platform for the lower deck 5. The lower deck 5 has a forecastle deck 9. The hull/pontoon 1 has ballast tanks, fuel tanks, FW tanks and thrusters engine room (not shown). The lower deck 5 is connected to the deck box/upper deck 2 by a plurality of columns 4. Preferably, there are four to ten columns. The lifting and lowering device 3 is also provided on the upper deck 2. As it is amply clear from the FIG. 1, the assembly of the upper deck 2, the deck box, the columns, and the lower deck 5 are so designed together in coherence with the hull/pontoon which is similar to that of a ship hull and is submersible, so that the mono hull vessel in totality is ship shaped. This ensures that when the vessel is not submerged it can sail as a normal sailing vessel.

The mono hull column stabilized structure, together with the upper deck and the lower deck provides the desired stability to the vessel, so that it is effective in extremely hostile sea conditions, to perform a wide range of offshore operations. Thus it can work as any of or a combination of two or more of deep sea construction vessel, intervention vessel, construction vessel, drilling unit, Anchor Handling Tug Supply (AHTS), heavy lift vessel, windmill installation vessel, pipe layer, deep water mining vessel, accommodation unit, tender unit.

Figure 2:
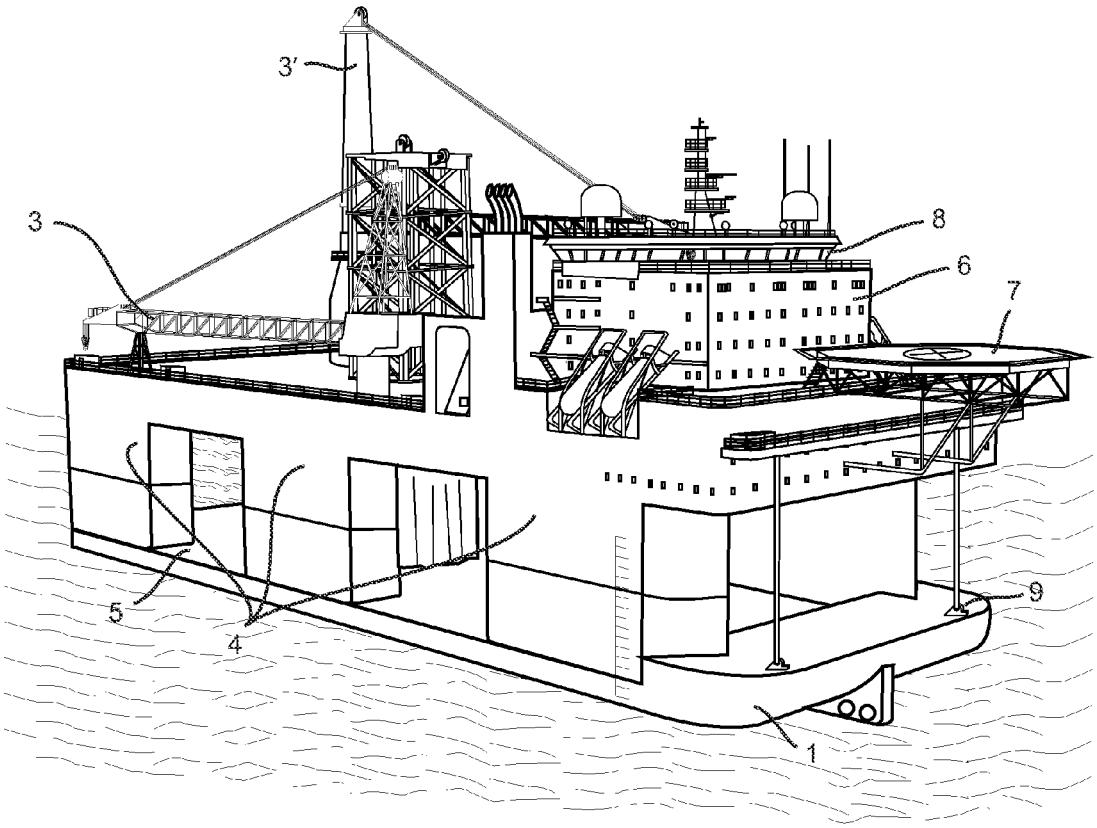
FIG. 2 illustrates another perspective view of a preferred embodiment of the mono hull vessel according to the present invention, in operation in offshore region.

The accompanying FIG. 2 shows the mono hull vessel in operation in offshore region. The like reference numerals indicate the same features as in FIG. 1 all such reference numerals are not inserted in this figure for the sake of clarity. This FIG. 2 also clearly shows the lifting arrangement 3' and the crane 3. From FIG. 2 also it will be clear, that the unit according to the present invention has a ship shaped submersible hull 1 and four to eight columns connecting the hull to the deck box. It is the hull/pontoon at the bottom in particular, in combination with the design of the other features, as described hereinbefore, which make it possible to operate the vessel as a normal ship.

The unit is deliverable in a wide range of sizes and with a wide range of capacities. The hull contains ballast tanks, fuel tanks, FW tanks and thrusters engine room (not shown). Preferably, the ballast tanks (not shown) are provided in the lower hull and parts of the columns 4. The unit preferably has a speed of 10-11 knots in sailing condition and is designed to do station keeping up to 6.5-meter waves, 2 knots current and 15 m/s wind in submerged condition. The deck box is preferably 120×45×6 m and contains engine room, large rooms for heavy equipments and accommodation units 6. The vessel is preferably equipped with six to 12 propellers depending on size and operational area. Columns are adjustable in respect of heights to fit operational requirements and environmental factors in actual operational area.

As stated before, the vessel is deliverable in all sizes say from 100-300 meters length and 45-70 meters width.

The vessel has ballast tanks mainly in the lower hull and parts of the towers (columns). The displacement in submerged condition is about 45000 tons. On deployment of a construction/equipment, the weight of the construction/equipment is compensated with water ballast when the construction/equipment is landed on the bottom. The construction/equipment is about 1% of the total displacement and has therefore only a limited impact on the vessel's stability. The vessel has preferably a loading capacity of about 6000-8000 tons on the uppermost deck.

It has been deciphered by experimental trial that the vessel according to the present invention, by virtue of the combination of its constructional features as described hereinbefore solves the known problems of motions in prior art and provides better and more stable work platform offshore, larger tank and DWT capacity. Furthermore, it has been found to be more flexible when it comes to sailing end entrance of ports compared to rigs. That apart, it provides better protection to all equipments going through the moon pool, as moon pool is arranged all the way from upper deck to bottom hull. This vessel sails as a normal vessel with low draft and provides good stability to crane operations. Additionally, great manoeuvrability is achieved due to location of thrusters. It has 11 knots speed in sailing condition and avoids large forces on cranes, lifting gear and constructions. It also operates, without heave compensator on the crane, has lower requirement for safety factor and higher lifting capacity, avoid damages on construction and lifting arrangement. It can hold large capacities on sections and has been found to be capable in extremely rough sea conditions.

Figure 3:
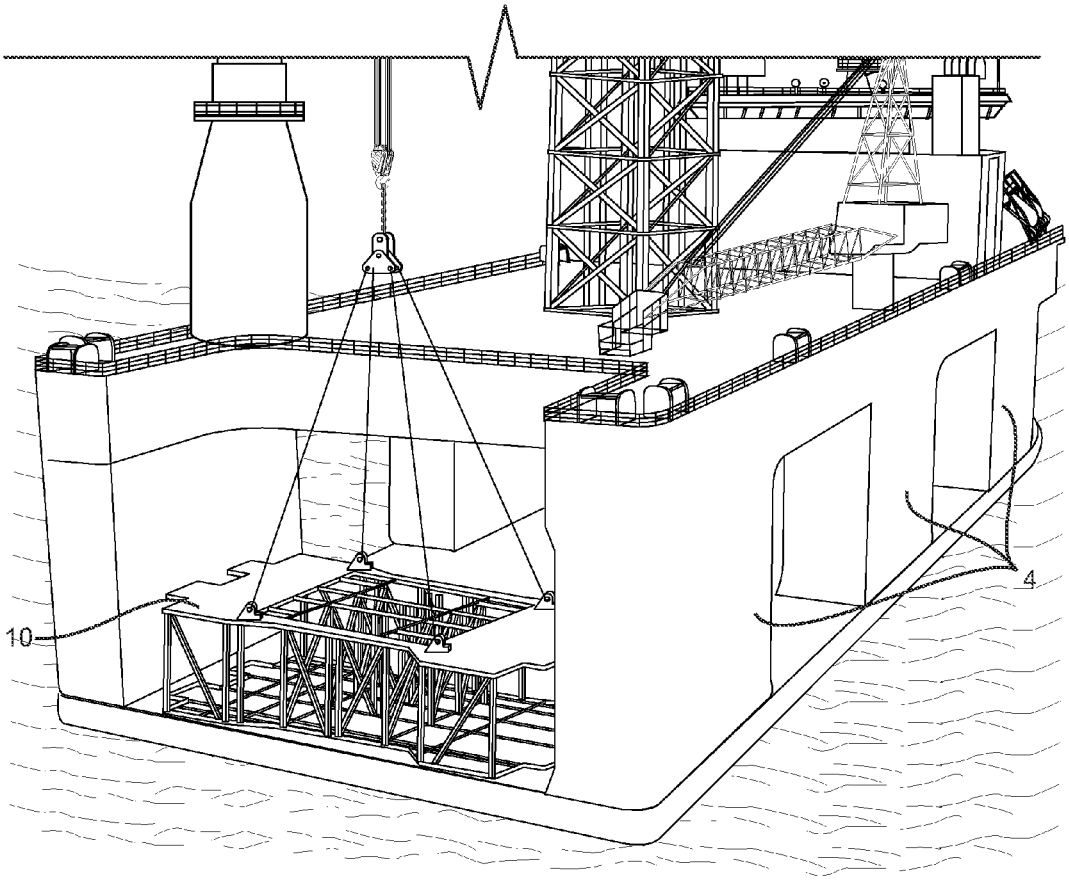
FIGS. 3 to 5 illustrate different stages in that order of a preferred method of submerging heavy equipment in offshore region according to the present invention.
Figure 4:
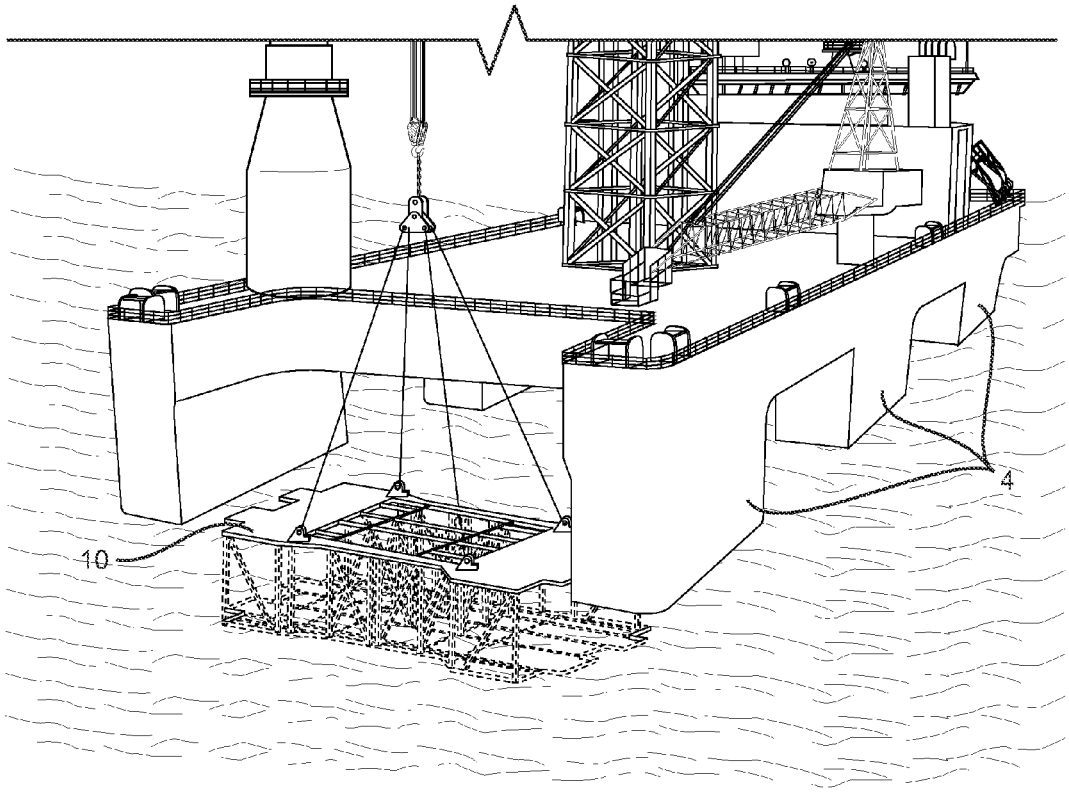
Figure 5:
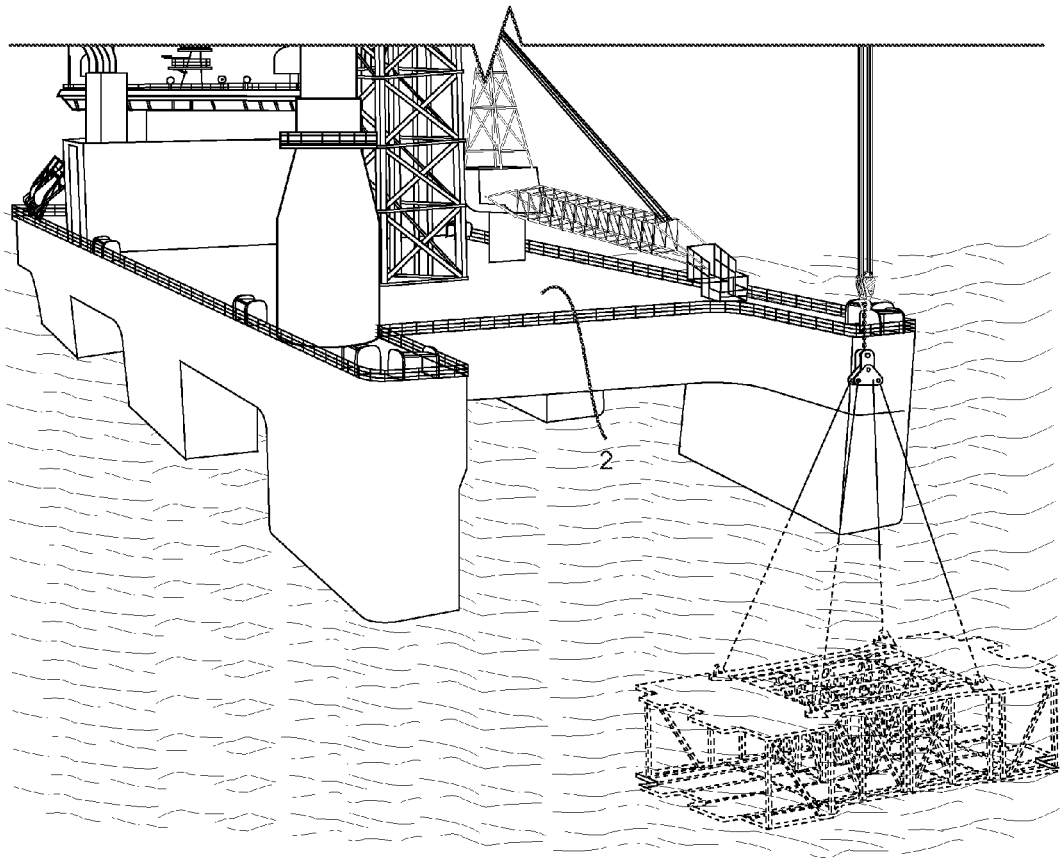

The accompanying FIGS. 3 to 5 illustrate how the vessel according to the present invention, deploys (and likewise retrieves) large heavy equipments 10 by submerging, without subjecting the equipment and lifting/lowering device to the dynamic forces of the splash zone, instead of following the usual method of lowering (or lifting) the heavy equipment through water line. This is a remarkable trait of the present invention. In the FIGS. 3 to 5 the like reference numerals indicate the same features as in FIGS. 1 and 2 and all such reference numerals are not inserted in these figures for the sake of clarity.

At the first point, large constructions/modules are loaded on the upper deck 2 in port and transported out to the actual location offshore, as the vessel can work as a normal sailing vessel, in non-submerged condition. The spacious upper deck is very clearly visible in the accompanying FIG. 5 and it has a space for passage of the equipment 10. The construction/equipment 10 is lowered on the lower deck 5 as shown in the FIG. 3. While the equipment is on the lower deck, it is submerged slowly, by gradual sinking of the lower deck below the water line, as illustrated in FIG. 4. Before the equipment is submerged to about 3 to 4 m below the water surface, the lifting arrangement 3' is connected to the crane 3. After the equipment is under water, it is lifted about say one meter above lower deck 5, turned aft and lowered down the bottom. This is illustrated in the accompanying FIG. 5. Thus, by avoiding lowering of heavy equipments through the splash zone, the dynamic forces on the equipment and lifting/lowering device are drastically reduced. In many ocean areas, such as the North Sea, the wave height is considerable (several meters) and if such waves hits the equipment placed on deck or which is lowered from the surface, it can have a deteriorating effect on the equipment or the lifting devices. By lowering the equipment below the sea surface (and under the influence of the waves) before further lowering by cranes etc. to the ocean floor, two benefits are obtained, namely, the equipment is not influenced by the wave forces, and also and interestingly, the weight of the equipment is reduced due to buoyancy.

Similarly, the vessel avoids the dynamic forces of the splash zone on the equipments and lifting/lowering devices, during retrieving the equipment. Retrieval steps will obviously be just the opposite and is not shown in the accompanying figures. However, as a person skilled in the art will understand the method of retrieving heavy equipments according to the present invention, comprises the steps of submerging the vessel such that the lower deck is at a desired depth below the water level, lifting and placing the equipment on the lower deck from water by the lifting arrangement 3' and crane 3 and moving the vessel up the water such that the lower deck is above the water level. As a further optional and subsequent step, the equipment 10 is lifted on the upper deck 2 by means of a lifting arrangement 3' detachably attached to a crane 3.

Figure 6:
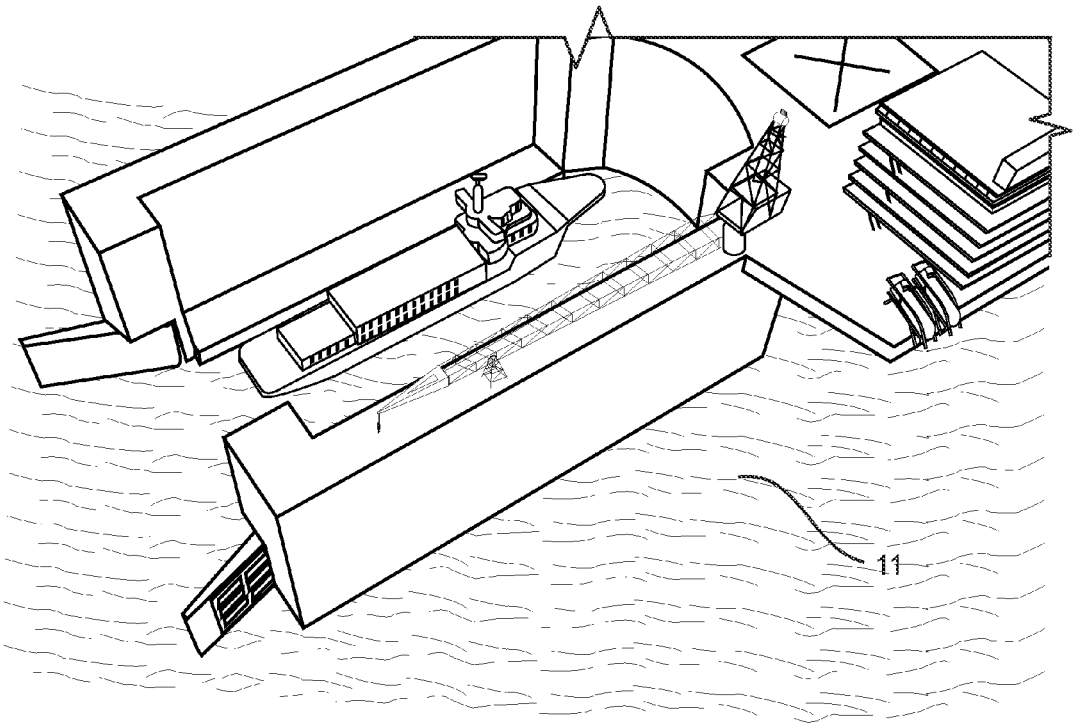
FIG. 6 illustrates a view of the temporary port in the aft region of the mono hull vessel according to the present invention with the sluice gates open.
Figure 7:
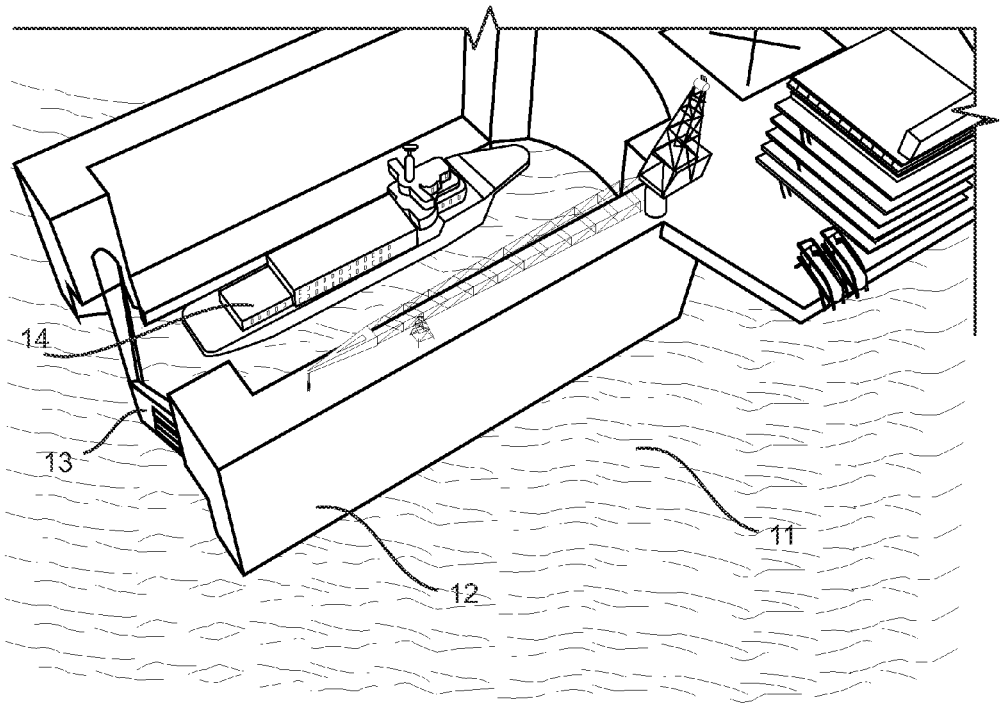
FIG. 7 illustrates another view of the temporary port in the aft region of the mono hull vessel according to the present invention with the sluice gates closed.

The accompanying FIGS. 6 and 7 show a further advantageous constructional feature of the vessel according to the present invention. It shows a temporary port 11 at the aft region of the vessel. The port also has a large ship shaped hull/pontoon at the bottom (not visible) just like the vessel and functions on an identical principle. The temporary port is preferably 300×70 m and is capable of accommodating crew vessel(s)/supply vessel(s)/any other vessel(s) 14. A plurality of such vessels may be accommodated depending upon size. Normally, a vessel may be accommodated having up to 70 m length and 6 m draft. Such vessel 14 may be any vessel utilized for safe transfer of crew and material, as will be understood by persons skilled in the art and is not restricted to the exemplary illustration in FIGS. 6 and 7. The gate astern 13 is preferably 40 m and is adapted to close very fast. The temporary port is adapted to be moored on a turret system (not shown) and will therefore always head on the weather. The area behind the unit is a sheltered area 12 and hence when the vessel is submerged the crew vessel, supply vessel or any other vessel 14 is able to enter even in quite rough weather through the sluice gates 13. When the crew vessel/supply vessel/any other navigating vessel 14 enters, the sluice gates 13 are closed and hence a shallow port is formed where the crew/material can be transferred safely. This facility is particularly helpful, when the helicopters are out of reach.

Following are some of the non-limiting specifications of the vessel according to a preferred embodiment.

Main Particulars
Length over all (LOA): 120.60 m
Length between perpendiculars (LPP): 120.60 m
Breadth moulded: 45.00 m
Depth mld. to main deck: 7.35 m
Draught scantling: 16.00 m
Operation draft approx.: 15.00 m
Design draught: 5.12 m
Upper pontoon, Depth mld. to lower deck: 24.20 m
Upper pontoon, Depth mld. to upper deck: 30.20 m
Frame spacing (transverse girders): 1.800 mm Tonnage, UMS (1969), approx.: 30.000
Capacities
Deadweight at SWL, draft 5.12 m, approx.: 9.500 MT
Deadweight at operation draft 15.0 m, approx.: 30.800 MT
Working deck area on upper deck, moon pool etc. deducted, approx.: 3.350 m2
Working deck load on upper deck: 5 MT/m2
Speed
Vessel trial speed shall be measured (double run) before delivery with clean hull and calm sea (max. Beaufort 2) based on following:
Trial speed, approx: 11.0 knots
Draft even keel summer loadline: 5.12 m
Station Keeping
The vessel shall be able to operate in DP class 2 in the following weather condition for following sea, wind, current and all vessel headings:
Sea: 6.5 m significant wave height/Tp=10 seconds
Wind: 15 m/s
Current: 0.9 m/s surface current
For purposes of Movement Analysis:
Sea: 6.5 m significant wave height/Tp=9 to 17 secs
Accommodation
Ref. vessel General Arrangement plan
The vessel shall accommodate 120 persons including marine crew and special purpose crew.
Effort has been made to standardize the cabin size and layouts with 4 different cabin layouts.
Machinery/Propulsion
8×2600 KW generators
2×2200 KW Azimuths aft
4×2200 KW Retractable azimuths Fore and aft ship
2× 2200 KW Bow thrusters The following non-limiting advantages are achieved by the present invention.

Ship shaped, column stabilized unit with upper deck.
Sail as a vessel operate as a rig.
Comparable to rig but to a much lower cost.
Much less motion than vessels of today, great damping effect of the lower hull.
Better stability then comparable units.
Large loading capacities.
Large working deck.
Arrive ports on a very low draft.
Large range of application, Intervention vessel, construction vessel, Drilling unit,
Anchor Handling Tug Supply (AHTS), Heavy lift vessel, Windmill installation vessel, Pipe layer, Deep water mining vessel, Accommodation unit, Tender Unit.
Lower constructions/equipments through the water while they are standing on deck.
Reduce dynamic forces on crane, lifting gear and construction.
Large capacity with sections up to 30×15×10 m.
Provide a safe port offshore for crew vessels/supply vessels/other small vessels through a gate astern, extreme capacity when it comes to accommodation and deck space.
Reduced costs.
Larger and more stabile working platform.
Avoid splashing effect problems during deployment of subsea constructions/equipments so that the equipments and the lifting/lowering devices are not influenced by the wave forces, and simultaneously the weight of the equipments are reduced due to buoyancy.
Reduce forces on tower, riser, crane, lifting gear and constructions.
Able to work in much more harsh weather than an offshore vessel.

The present invention has been described with reference to some preferred embodiments and some drawings for the sake of understanding only and it should be clear to persons skilled in the art that the present invention includes all legitimate modifications within the ambit of what has been described hereinbefore and claimed in the appended claims.

The invention claimed is:

1. A mono hull vessel for retrieving and deploying equipments in offshore region comprising:
a deck box with an upper deck at a top of the deck box, the upper deck comprising a lifting and lowering device;
a hull at a base of said mono hull vessel, the hull being of a single-piece construction and comprising a platform for a lower deck, the hull being submersible and comprising a shape of a ship's hull;
a plurality of columns connecting the hull to the deck box;
a lifting device is disposed on the upper deck to allow lifting and lowering of equipment between the upper deck and the lower deck;
wherein the lower deck of the mono hull vessel is adapted to submerge to and from a desired depth below a water level;
wherein said plurality of columns are 4 to 10 in number; and
wherein the mono hull vessel functions as a surface sailing vessel when in a non-submerged condition.

2. The mono hull vessel according to claim 1, wherein a moon pool is arranged between the upper deck and the bottom hull.

3. The mono hull vessel according to claim 1, comprising a temporary port unit disposed at an aft region of the mono hull vessel for at least one of crew vessels, supply vessels, and other vessels.

4. The mono hull vessel according to claim 3, wherein the port unit comprises:
a sluice gate at an end of the aft region; and
a sheltered area.

5. A method for submerging equipment, the method comprising:
placing equipment on a lower deck of a mono hull vessel from an upper deck of the mono hull vessel by a lifting device, the lifting device being disposed on the upper deck, the lower deck being connected to the upper deck by a plurality of columns;
submerging the lower deck to a desired depth below a water level;
lifting, via the lifting device, the equipment partially above the lower deck; and
turning the equipment and lowering the equipment in water the lifting device.

6. A method according to claim 5, comprising:
submerging the mono hull vessel such that the lower deck is at a second desired depth below the water level;
lifting and placing the equipment on the lower deck from water by the lifting device; and
moving the mono hull vessel up in the water such that the lower deck is above the water level.

* * * * *